United States Patent [19]

Miyamoto

[11] Patent Number: 4,488,477

[45] Date of Patent: Dec. 18, 1984

[54] RODLESS CYLINDER

[75] Inventor: Michikazu Miyamoto, Soka, Japan

[73] Assignee: Shoketsu Kinzoku Kogyo Kabushiki Kaisha, Tokyo, Japan

[21] Appl. No.: 436,367

[22] Filed: Oct. 25, 1982

[30] Foreign Application Priority Data

Nov. 19, 1981 [JP] Japan ..... 56-172476[U]

[51] Int. Cl.[3] ..... F01B 11/02

[52] U.S. Cl. ..... 92/85 R; 92/255; 91/DIG. 4; 60/545

[58] Field of Search ..... 91/1, DIG. 4; 92/51, 92/52, 5 R, 85 R, 255; 200/81.9 M, 82 E, 83 L; 60/545; 335/302, 306, 288

[56] References Cited

U.S. PATENT DOCUMENTS 2,983,840 5/1961 Van Iperen ..... 335/302

FOREIGN PATENT DOCUMENTS 634420 1/1962 Canada ..... 92/85 R 1317105 5/1973 United Kingdom ..... 91/DIG. 4

*Primary Examiner*—Robert E. Garrett

*Assistant Examiner*—Scott L. Moritz

*Attorney, Agent, or Firm*—Oblon, Fisher, Spivak, McClelland & Maier

[57] ABSTRACT

A rodless cylinder having a piston and an operation member slidable along the outer circumferential surface of a cylinder tube, each mounted with permanent magnets, and adapted to move the operation member along the cylinder tube by utilizing the attraction force between these permanent magnets, in which a plurality of individual magnets disposed axially to the cylinder in each of driving and driven magnet rows are arranged such that identical poles of the individual magnets are in adjacent to each other, and both of the driving and driven magnet rows are arranged such that the different poles of the individual magnets in each of the magnet rows are opposed to each other can provide a greater attraction force between the magnet rows with no changes in the size of the magnet and thereby reduce the size of the entire apparatus.

7 Claims, 4 Drawing Figures

RODLESS CYLINDER

BACKGROUND OF THE INVENTION (1) Field of the Invention

This invention concerns a rodless cylinder.

(2) Description of the Prior Art

Cylinder apparatus in which a piston driven within a cylinder tube by the pressure of a fluid introduced therein have often been utilized generally. In the cylinder apparatus of this type, a rod mounted to the piston is extended from one end of a cylinder tube externally and a load is connected to the top end of the rod. However, in a state where the rod is projected to its extreme stroke end out of the cylinder tube, the entire length including the rod and the cylinder tube is approximately twice as long as the rod stroke. Thus, the cylinder apparatus of this type requires a relatively large installation space as compared with the stroke of the piston rod.

In view of the above, a so-called rodless cylinder has been developed as disclosed in Japanese Patent Publication No. 25034/1980 filed in Japan based on British Patent Application No. 4890/1971, in which a piston and an operation member slidion along the outer circumferential surface of a cylinder tube are mounted with permanent magnets respectively and the operation member is moved along the cylinder tube by utilizing the attraction force between the permanent magnets. FIG. 1 shows a schematic structure of the rodless cylinder, wherein a piston 2 disposed in a cylinder tube 1 and an operation member 3 fitted over the outer circumferential surface of the cylinder tube 1 are respectively mounted with magnet rows each consisting of a plurality of permanent magnets 4, 4, . . . and 5, 5, . . . arranged side by side and the different poles of the individual magnets in each of the magnet rows are opposed to each other respectively, so that the operation member is moved by the attraction force between the permanent magnets 4 and 5 following after the movement of the piston 2 driven by the pressure of a fluid. By the way, in the rodless cylinder as described above, the magnets 4 and 5 are arranged in the axial direction of the cylinder tube 1 with the different poles of the individual magnets in each of the magnet rows being adjacent to each other. Accordingly, it is necessary to increase the magnetic force, i.e., the size, or the number of the magnets constituting the magnet row in order to enhance the attraction of holding force between the magnet rows. This, however, increases the size and the cost of the entire apparatus, which is contrary to the essential purpose of the rodless cylinder of reducing the apparatus size.

BRIEF SUMMARY OF THE INVENTION

Accordingly, it is an object of this invention to provide a rodless cylinder capable of obtaining a greater attraction force between a driving magnet row mounted to a piston and a driven magnet row disposed to the outer circumferential surface of a cylinder tube with no changes in the size and the number of the magnets by providing an adequate pole arrangement for the individual magnets in each of the driving and driven magnet rows.

Another object of this invention is to provide a rodless cylinder capable of obtaining a greater attraction force between the driving magnet row and the driven magnet row, which enables the use of small-sized magnets, thereby reducing the size and the cost of the apparatus.

A further object of this invention is to provide a rodless cylinder in which the driven magnet row can surely move following after the movement of the driving magnet row by a greater attraction force between the driving magnet row and the driven magnet row.

Other objects and aspects of this invention will become clearer by reading the following explanations for preferred embodiments of this invention in conjunction with the appended drawings.

The above objects can be attained by the rodless cylinder in accordance with this invention, in which a driving member driven within a cylinder in a axial direction by the pressure of a fluid is constituted by mounting a driving magnet row to a piston sliding in the cylinder and a driven member disposed to the outer circumference of the cylinder axially slidably is mounted with a driven magnet row, wherein a plurality of individual magnets disposed axially to the cylinder in each of the magnet rows are arranged such that the identical poles of the individual magnets are in adjacent to each other, and each of the magnet rows are arranged such that the different poles of the individual magnets are opposed to each other.

DESCRIPTION OF THE PREFERRED EMBODIMENT

Figure 4:
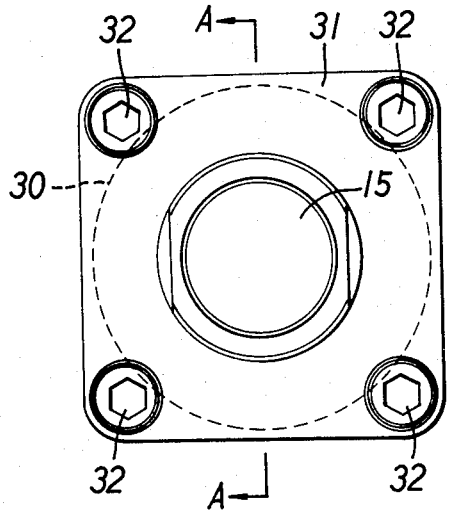
FIG. 4 is an end view of the rodless cylinder shown in FIG. 2.
Figure 2:
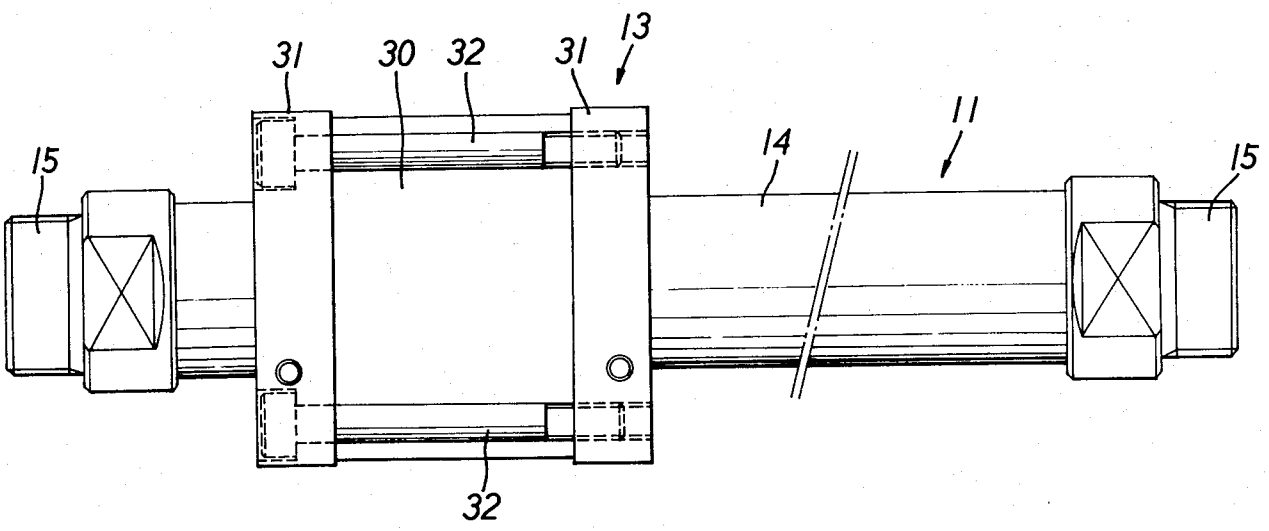
FIG. 2 is a side view for a preferred embodiment according to this invention.
Figure 3:
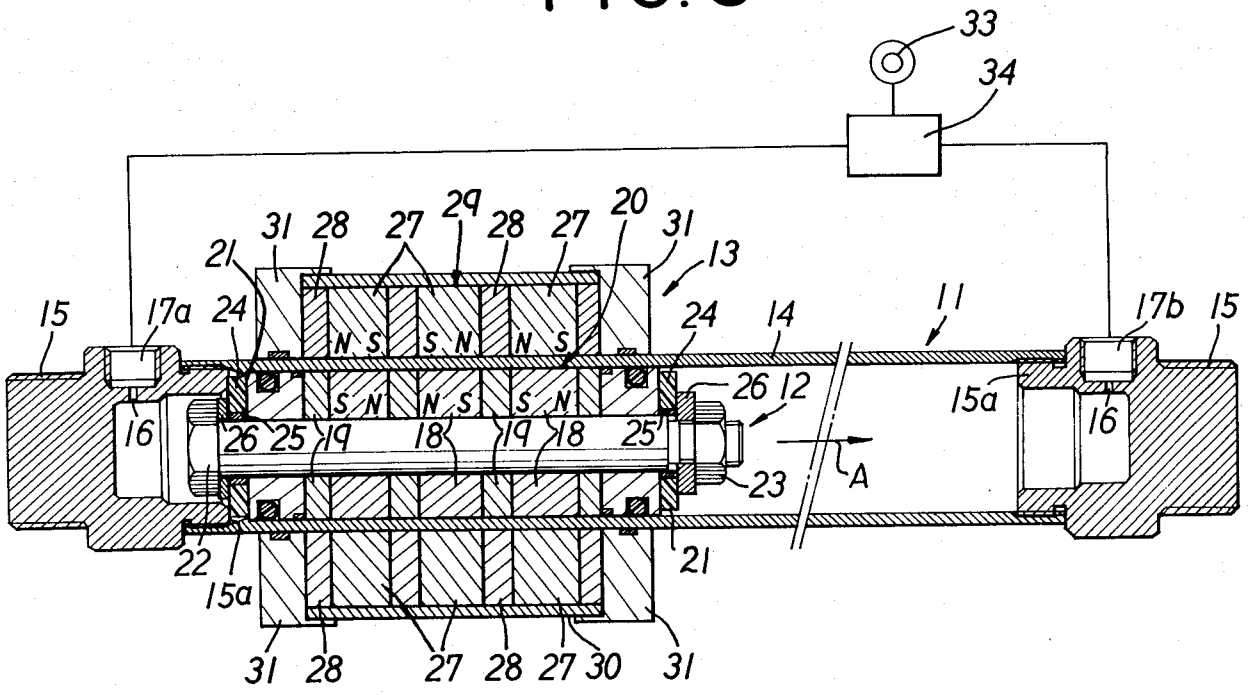
FIG. 3 is a cross sectional view taken along the line A—A in FIG. 4.
Figure 1:
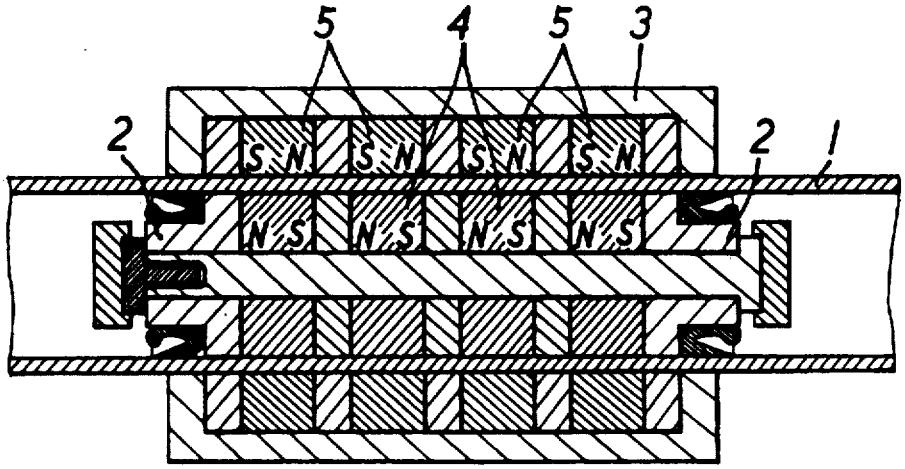
FIG. 1 PRIOR ART
Figure 4:
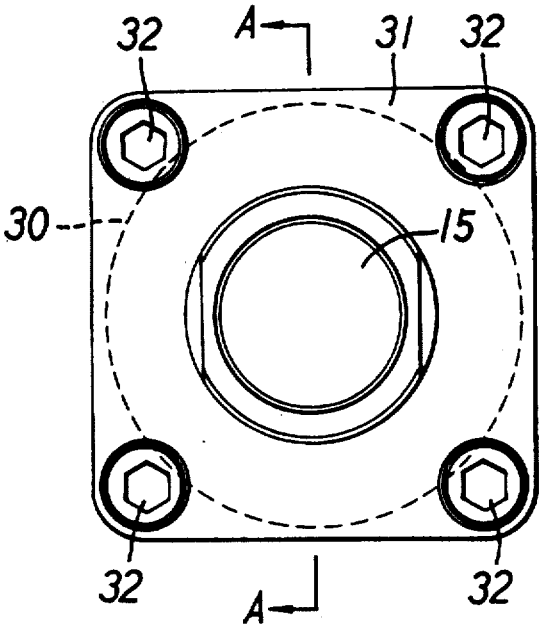
Figure 2:
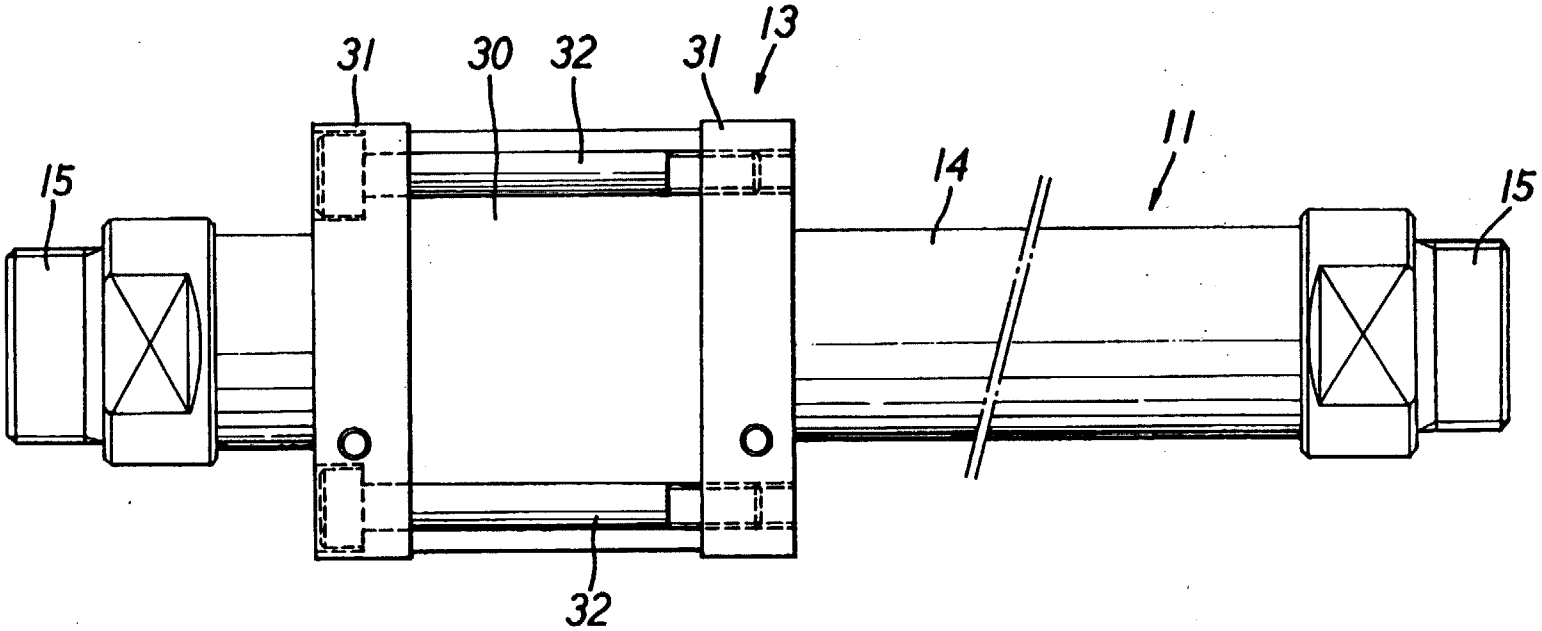
Figure 3:
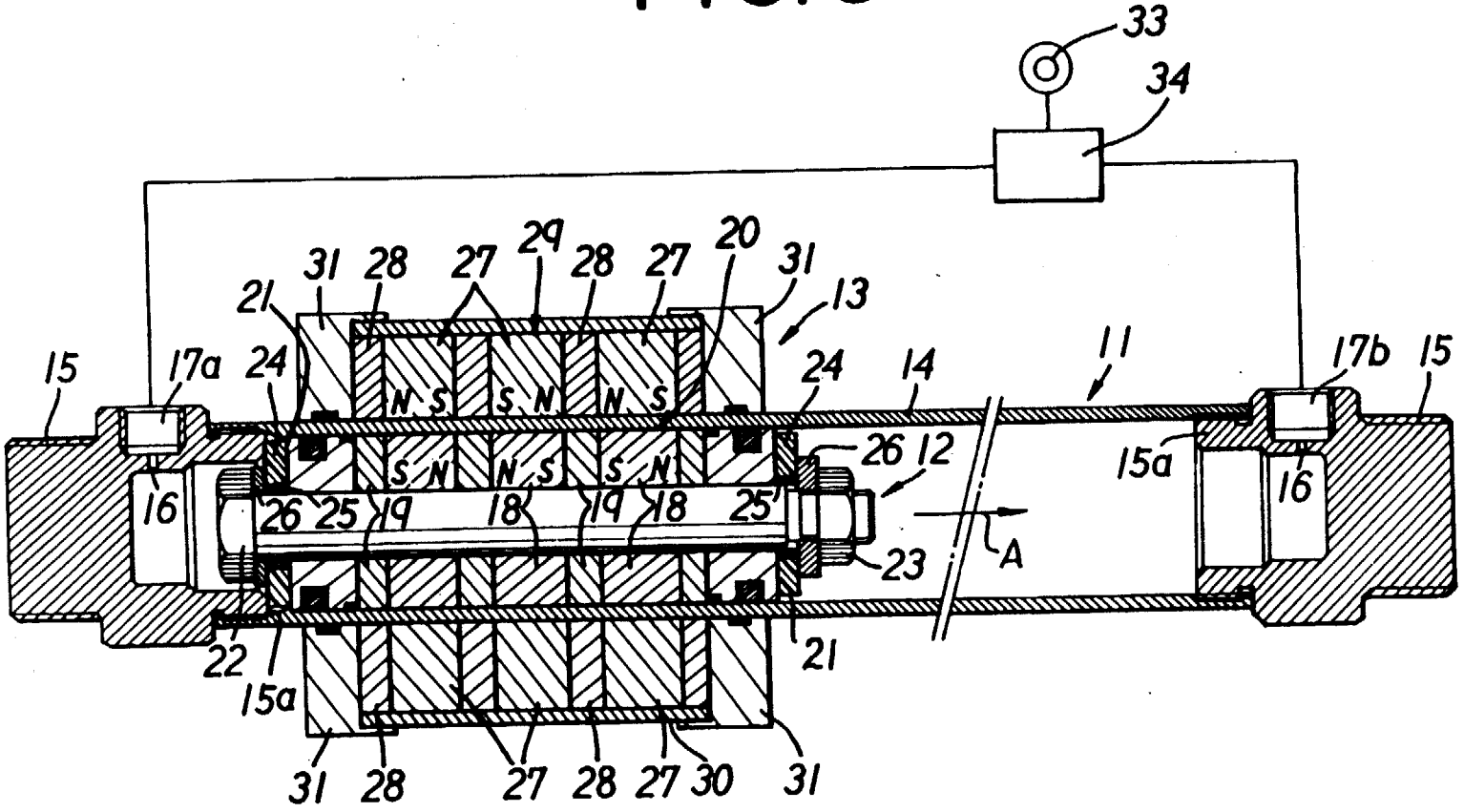

This invention is to be described specifically by way of its preferred embodiment referring to the drawings. In FIG. 2 through FIG. 4 are shown a cylinder 11, a pistonlike driving member 12 inserted fittedly to the inside of the cylinder 11 axially slidably and a driven member 13 which moves following after the movement of the driving member 12.

The cylinder 11 comprises a cylinder tube 14 made of non-magnetic material such as aluminum and head covers 15, 15 threadingly secured to the both ends thereof. Each head cover 15 is perforated with charge and discharge ports 17*a*, 17*b* for high pressure fluid in communication with the inside of the cylinder tube 14 by way of through holes 16.

The driving member 12 is adapted to reciprocate axially within the cylinder by the pressure of a high pressure fluid charged and discharged to and from the charge and discharge ports 17*a*, 17*b* in the head covers 15, 15. The driving member 12 comprises a driving magnet row 20 formed by alternately arranging a plurality of permanent magnets 18, 18, . . . and yokes 19, 19, . . . each with a central aperture, which are put between a pair of pistons 21, 21 and integrated, by being clamped with a bolt 22 inserted through the central apertures and a nut 23, together with dampers 24, 24 for abutting against stoppers 15*a* situated on the stroke ends within the cylinder, damper washers 25, 25 for restricting the compression of the dampers and flat washers 26, 26 abutting against the surface of the dampers for holding the same.

The driven member 13 in the form of a ring is inserted over the outer circumference of the cylinder tube 14 axially slidably and it comprises a driven magnet row 29 formed by alternately disposed a plurality of ring-like permanent magnets 27, 27, . . . and yokes 28, 28, . . . which are covered by a tube 30 at the outer circumference of the magnet row and fitted with a pair of fixing covers 31, 31 at the both ends of the tube 30 and integrated by being clamped with a bolts 32 inserted between the fixing covers 31, 31.

In each of the magnet rows 20 and 29, individual permanent magnets 18, 27 are arranged axially to the cylinder 11 such that the identical poles of the individual magnets are in adjacent to each other. The magnet rows 20 and 29 are arranged such that the different poles of the corresponding magnets 18 and 27 in each of the rows are opposed radially to each other by way of the cylinder tube 14.

Specifically, in the driving magnet row 20, a plurality of individual permanent magnets 18, 18 are arranged in the adverse direction alternately so that their identical poles S, S and N, N are adjacent to each other. In the driven magnet row 29, a plurality of individual magnets 27, 27, . . . corresponding in the number to that in the driving magnet row are arranged such that their identical poles S, S and N, N are adjacent to each other. Further, the driving magnet row 20 and the driven magnet row 29 are arranged such that the N poles of the individual magnets in the driving magnet row 20 are opposed to the S poles of the individual magnets in the driven magnet row 29 and S poles of the individual magnets in the driving magnet row 20 are opposed to the N poles of the individual magnets in the driven magnet row 29 respectively.

In the drawing, also shown are a pressurized fluid source 33, and a switching valve 34 that switchingly supplies a pressurized fluid from the pressurized fluid source 33 to either one of the charge and discharge ports 17*a*, 17*b* in the head cover 15 and discharges the pressurized fluid from the other of the charge and discharge ports to the outside.

In the rodless cylinder having a constitution as described above, when a high pressure fluid is supplied from the charge and discharge port 17*a* to the cylinder 11 at the switching position shown in FIG. 3, the driving member 12 moves in the direction of the arrow A while discharging the fluid on the opposite side in the inside of the cylinder 11 through the other charge and discharge port 17*b*, whereby the driven member 13 moves by the attraction force between both of the magnet rows 20 and 29 following after the movement of the driving member 12. Alternately, when a high pressure fluid is supplied to the charge and discharge port 17*b*, the driving member 12 and the driven member 13 can be driven in the opposite direction.

Figure 1:
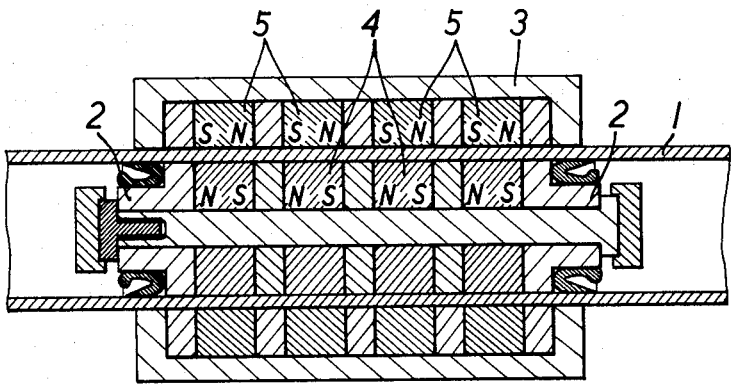
FIG. 1 PRIOR ART
FIG. 1 is a cross sectional view for a part of a conventional rodless cylinder.

In the rodless cylinder of the illustrated embodiment, since the magnets 18, 27 in the magnet rows 20, 29 are arranged respectively so that the identical pole of the individual magnets are adjacent to each other in each of the rows, the attraction force between both of the magnet rows 20 and 29 can be made remarkably greater as compared with that of the embodiment shown in FIG. 1, wherein the different poles for the magnets 4, 4, . . . and 5, 5, . . . are adjacent to each other in the axial direction in each of the magnet rows at the inside and the outside of the cylinder 1.

Table 1 shows the results of the measurement for the difference in the attraction force between the magnet rows in each of three types of rodless cylinders having the same basic structure, with respect to the case where the magnets are arranged according to this invention and in the case where the magnets are arranged in the conventional manner as shown in FIG. 1. As apparent from the Table 1, the magnet arrangement according to this invention can increase the attraction force between the magnet rows approximately five times as large as that of the embodiment shown in FIG. 1.

TABLE 1

| | Arrangement (in this invention) | Arrangement (in the prior embodiment) |
|---|---|---|
| Cylinder I | 13.6 (kgf) | 2.35 (kgf) |
| Cylinder II | 13.4 | 2.33 |
| Cylinder III | 12.0 | 2.25 |

As stated above, the attraction force between the magnet rows can be increased significantly by the rodless cylinder according to this invention, in a simple structure wherein a plurality of individual magnets are arranged appropriately, in each of the driving magnet row mounted to the piston disposed to the inside of the cylinder and the driven magnet row disposed to the outside of the cylinder.

What is claimed is:

1. A rodless cylinder, in which a driving member driven within a cylinder in the axial direction by the pressure of a fluid is constituted by mounting a driving magnet row to a piston sliding in said cylinder and a driven member disposed to the outer circumference of said cylinder axially slidably is mounted with a driven magnet row, wherein a plurality of individual magnets disposed axially to the cylinder in each of said magnet rows are arranged such that the identical poles of said individual magnets are adjacent to each other, and each of said magnet rows are arranged such that the different poles of said individual magnets are opposed to each other.

2. The rodless cylinder as defined in claim 1, wherein said driving magnet row is formed by alternately arranging a plurality of driving magnets and yokes having central apertures perforated therein respectively and said driven magnet row is formed by alternately arranging a plurality of ring-like driven magnets and yokes.

3. The rodless cylinder as defined in claim 1, wherein said driving magnet row comprises a plurality of permanent magnets which are arranged so that the individual magnets are disposed with their identical poles, that is, S, S and N, N being adjacent to each other respectively, and said driven magnet row also comprises a plurality of permanent magnets corresponding in number to that of said driving magnet row which are arranged so that the individual magnets are disposed with their identical poles, that is, S, S and N, N being in adjacent to each other respectively, and in which said driving magnet row and the driven magnet row are arranged such that the N poles of the individual magnets in one of the magnet rows correspond to the S poles of the individual magnets in the other of the magnet rows respectively while the S poles in the individual magnets in one of the magnet rows correspond to the N poles of the individual magnets in the other of the magnet rows respectively.

4. The rodless cylinder as defined in claim 1, wherein said driving magnet row is put between a pair of pistons and they are integrated together with dampers abutting against stoppers situated at the stroke ends in the cylinder by being clamped with a bolt inserted through central apertures in said individual magnets.

5. The rodless cylinder as defined in claim 1, wherein the driven magnet row is covered at the outer periphery thereof with a tube the axial length of which corresponds to the axial length of said driven magnet row, wherein said driven magnet row is fitted with a pair of cup-shaped fixing covers on both ends of said tube, each end of said driven magnet row and said tube being received in one of said cup-shaped covers, and wherein said driven magnet row, said tube, and said cup-shaped fixing covers are integrated by being clamped with a plurality of bolts inserted between said fixing covers.

6. The rodless cylinder as defined in claim 4, wherein said cylinder is fitted with a head cover at either end thereof, said head covers contain inwardly directed axial recesses which receive the ends of said bolt at the stroke ends, and said stoppers project axially inwardly from said head covers radially outwardly of said axial recesses.

7. A rodless cylinder having a cylinder, a driving member which is assembled with a piston and a driving magnet row slidably disposed in said cylinder and movable therein by a pressurized fluid along the axial direction of said cylinder, and a driven member which has a driven magnet row surrounding the outer periphery of said cylinder, each of said driving and driven magnet rows comprising a plurality of individual permanent magnets juxtaposed along the cylinder axis, characterized in that axially adjacent pairs of permanent magnets in each row are arranged to face identical poles in the axially adjacent magnets, thereby turning lines of magnetic force substantially perpendicularly to the cylinder axis, while radially opposed pairs of magnets are arranged to face different poles, thereby preventing independent movements of said rows, whereby said driven member stably follows the movement of said driving member.

* * * * *

REEXAMINATION CERTIFICATE (1428th)

United States Patent [19] [11] B1 4,488,477

Miyamoto [45] Certificate Issued Mar. 12, 1991

[54] RODLESS CYLINDER

[75] Inventor: Michikazu Miyamoto, Soka, Japan

[73] Assignee: Shoketsu Kinzoku Kogyo Kabushiki Kaisha, Japan

Reexamination Request:
No. 90/001,910, Dec. 18, 1989

Reexamination Certificate for:

| | |
|---|---|
| Patent No.: | **4,488,477** |
| Issued: | **Dec. 18, 1984** |
| Appl. No.: | **436,367** |
| Filed: | **Oct. 25, 1982** |

[30] Foreign Application Priority Data

Nov. 19, 1981 [JP] Japan ..... 56-172476

[51] Int. Cl.[5] ..... F01B 11/02

[52] U.S. Cl. ..... 92/85 R; 92/255; 91/DIG. 4; 60/545

[58] Field of Search ..... 91/1, DIG. 4; 92/51, 92/52, 5 R, 85 R, 255; 200/81.9 M, 82 E, 83 L; 60/545; 335/302, 306, 288; 417/418

[56] References Cited

U.S. PATENT DOCUMENTS

| | | |
|---|---|---|
| 3,779,401 | 12/1973 | Carroll . |
| 4,207,807 | 6/1980 | Takata et al. . |
| 4,231,722 | 11/1980 | Teichmann . |

FOREIGN PATENT DOCUMENTS

| | | |
|---|---|---|
| 47-19164 | 6/1972 | Japan . |
| 48-5333 | 2/1973 | Japan . |
| 53-154988 | 12/1978 | Japan . |
| 2045389 | 10/1980 | United Kingdom . |

*Primary Examiner*—Edward Look

[57] ABSTRACT

A rodless cylinder having a piston and an operation member slidable along the outer circumferential surface of a cylinder tube, each mounted with permanent magnets, and adapted to move the operation member along the cylinder tube by utilizing the attraction force between these permanent magnets, in which a plurality of individual magnets disposed axially to the cylinder in each of driving and driven magnet rows are arranged such that identical poles of the individual magnets are in adjacent to each other, and both of the driving and driven magnet rows are arranged such that the different poles of the individual magnets in each of the magnet rows are opposed to each other can provide a greater attraction force between the magnet rows with no changes in the size of the magnet and thereby reduce the size of the entire apparatus.

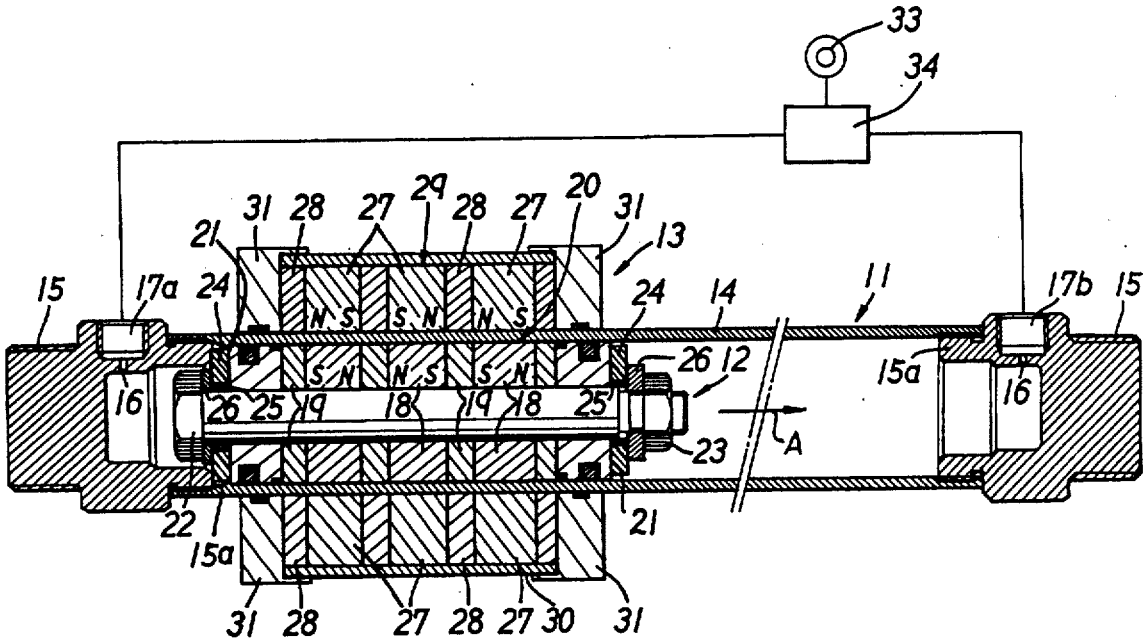

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Amend the paragraph beginning at line 12 of column 2:

The above objects can be attained by the rodless cylinder in accordance with this invention, in which a driving member driven within a cylinder in a axial direction by the pressure of a fluid is constituted by mounting a driving magnet row to a piston sliding in the cylinder and a driven member disposed to the outer circumference of the cylinder axially slidably is mounted with a driven magnet row, wherein a plurality of individual magnets disposed axially to the cylinder in each of the magnet rows are arranged such that the identical poles of the individual magnets are in adjacent to each other, and each of the magnet rows are arranged such that the different poles of the individual magnets are opposed to each other. *The driving magnet row is put between a pair pistons and integrated together. Dampers abut against stoppers situated at the stroke ends in the cylinder by being clamped with a bolt inserted through central apertures in the individual magnets. The cylinder is fitted with a head cover at either end thereof. The head covers contain inwardly directed axial recesses which receive the ends of the bolt at the stroke ends. The stoppers project axially inwardly from the head covers at locations radially outwardly of the axial recesses.*

*According to another feature of the invention, the rodless cylinder comprises an elongated cylinder formed of a non-magnetic material, head covers releasably connected to two axial ends of said cylinder, each of said head covers comprising an inwardly directed axial recess, an annular stopper projecting axially inwardly from said head cover at a position radially outward of said axial recess, and a port for supplying a pressurized fluid to the cylinder via the axial recess. A driving member fitted in the cylinder and movable in the cylinder in the axial direction thereof includes an alternating plurality of permanent magnets and yokes, the permanent magnets of the driving member being arranged such that identical poles of adjacent magnets face one another, a threaded rod passing through central apertures of the permanent magnets and yokes of the driving member, a pair of pistons secured to opposite ends of the plurality of magnets and yokes of the driving member by the threaded rod, and a pair of flat ring shaped dampers fitted to the driving member adjacent opposite axial ends thereof, the dampers extending axially to a position such that each of the dampers abuts a respective one of the stoppers when an axial end of the driving member enters the axial recess at an end of a stroke of the driving member, so that an area of contact between the dampers and stoppers is radially outside of the cylinder and is movable along the cylinder in the axial direction thereof. The driven member includes an alternating plurality of permanent magnets and yokes in radial alignment with the permanent magnets and yokes of the driving member, the magnets of the driven member being arranged such that identical poles of adjacent magnets face one another and such that radially aligned pairs of magnets of the driving and driven members have opposite poles in opposed alignment with each other, as well as a tube covering the outer circumference of the magnets and yokes of the driving member, and means for axially clamping the magnets and yokes of the driven member.*

Amend the paragraph beginning at line 53 of column 2.

The driving member 12 is adapted to reciprocate axially within the cylinder by the pressure of a high pressure fluid charged and discharged to and from the charge and discharge ports 17a, 17b in the head covers 15, 15. The driving member 12 comprises a driving magnet row 20 formed by alternately arranging a plurality of permanent magnets 18, 18, . . . and yokes 19, 19, . . . each with a central aperture, which are put between a pair of pistons 21, 21 and integrated, by being clamped with a bolt 22 (*i.e., a type of threaded rod*) inserted through the central apertures and a nut 23, together with dampers 24, 24 for abutting against stoppers 15a situated on the stroke ends within the cylinder *when the end of the driving member 12 enters an axial recess in the head cover 15 at the end of a stroke*, damper washers 25, 25 for restricting the compression of the dampers and flat *ring shaped* washers 26, 26 abutting against the surface of the dampers for holding the same. *The stoppers 15a are located radially outside of the axial recesses.*

AS A RESULT OF REEXAMINATION, IT HAS BEEN DETERMINED THAT:

Claims 4, 6 and 7 are cancelled.

Claim 1 is determined to be patentable as amended.

Claims 2, 3 and 5, dependent on an amended claim, are determined to be patentable.

New claims 8 and 9 are added and determined to be patentable.

1. A rodless cylinder, in which a driving member driven within a cylinder in the axial direction by the pressure of a fluid is constituted by mounting a driving magnet row to a piston sliding in said cylinder and a driven member disposed to the outer circumference of said cylinder axially slidably is mounted with a driven magnet row, wherein a plurality of individual magnets disposed axially to the cylinder in each of said magnet rows are arranged such that the identical poles of said individual magnets are adjacent to each other, and each of said magnet rows are arranged such that the different poles of said individual magnets are opposed to each other [.], *wherein said driving magnet row is put between a pair of pistons and they are integrated together with dampers abutting against stoppers situated at the stroke ends in the cylinder by being clamped with a bolt inserted through central apertures in said individual magnets, and wherein said cylinder is fitted with a head cover at either end thereof, said head covers contain inwardly directed axial recesses which receive the ends of said bolt at the*

*stroke ends, and said stoppers project axially inwardly from said head covers radially outwardly of said axial recesses.*

*8. A rodless cylinder, comprising:*

*an elongated cylinder formed of a non-magnetic material;*

*head covers releasably connected to two axial ends of said cylinder, each of said head covers comprising an inwardly directed axial recess, an annular stopper projecting axially inwardly from said head cover at a position radially outward of said axial recess, and a port for supplying a pressurized fluid to said cylinder via said axial recess;*

*a driving member fitted in said cylinder and movable in said cylinder in the axial direction thereof, said driving member comprising:*

*(a) an alternating plurality of annular permanent magnets and yokes, said permanent magnets of said driving member being arranged such that identical poles of adjacent magnets face one another,*

*(b) a threaded rod passing through central apertures of said permanent magnets and yokes of said driving member,*

*(c) a pair of pistons secured to opposite ends of said plurality of magnets and yokes of said driving member by said threaded rod, and*

*(d) a pair of flat ring shaped dampers fitted to said driving member adjacent opposite axial ends thereof, said dampers extending axially to a position such that each of said dampers abuts a respective one of said stoppers when an axial end of said driving member enters said axial recess at an end of a stroke of said driving member, whereby an area of contact between said dampers and said stoppers is radially outside of said threaded rod; and*

*a driven member fitted to the outside of said cylinder and movable along said cylinder in the axial direction thereof, said driven member comprising:*

*(e) an alternating plurality of annular permanent magnets and yokes in radial alignment with said permanent magnets and yokes of said driving member, said magnets of said driven member being arranged such that identical poles of adjacent magnets face one another and such that radially aligned pairs of magnets of said driving and driven members have opposite poles in opposed alignment with each other,*

*(f) a tube covering the outer circumference of said magnets and yokes of said driven member, and*

*(g) means for axially clamping said magnets and yokes of said driven member.*

*9. A rodless cylinder having a driving member, including a plurality of driving magnets, reciprocable within said cylinder in response to the fluid pressure therein, and a driven member, including a plurality of driven magnets, mounted externally of said cylinder for reciprocable movement in response to the movement of said driving member, wherein the driving magnets are disposed within, and extend side-by-side lengthwise of, said cylinder and are arranged so that the adjacent poles of adjacent driving magnets are identical; wherein the driven magnets are disposed externally of said cylinder and extend side-by-side lengthwise thereof, and are arranged so that the adjacent poles of adjacent driven magnets are identical but are of opposite polarity to the corresponding poles of the driving magnets adjacent thereto within the cylinder; wherein adjacent driving magnets and adjacent driven magnets are both separated, respectively, by yokes; wherein said cylinder is closed at each end by head covers each of which is provided with charge and discharge ports for high pressure fluid; wherein said driven member comprises a tube spaced from and mounted freely around the outer circumference of the cylinder so as to be axially slidable relative thereto; wherein said driving member also comprises a pair of pistons between which said driving magnets and separating yokes are clamped by bolt means; wherein a disk-shaped damper is clamped by said bolt means against the outer end of each piston for abutting against annular stoppers situated at the stroke ends of the driving members in said cylinder, said stoppers being provided on the inner ends of said head covers and forming substantially planar abutment surfaces for abutment by the peripheral portions of the outer faces of said dampers; and wherein said head covers are recessed to receive the lengths of said bolt means which project outwardly of said outer faces of said dampers when said driving member is at said stroke ends.*

* * * * *